United States Patent [19]

Bagley

[11] 3,994,190

[45] Nov. 30, 1976

[54] WORK SUPPORT FOR SHEAR

[75] Inventor: William Bagley, Bricktown, N.J.

[73] Assignee: Lawrence Peska Associates, Inc., New York, N.Y. ; a part interest

[22] Filed: Aug. 28, 1975

[21] Appl. No.: 608,779

[52] U.S. Cl. ..... 83/157
[51] Int. Cl.[2] ..... B26D 7/06
[58] Field of Search ..... 83/157

[56] References Cited

UNITED STATES PATENTS

| | | | |
|---|---|---|---|
| 2,311,618 | 2/1943 | Coleman | 83/157 |
| 3,176,559 | 4/1965 | Kootz | 83/157 |
| 3,260,145 | 7/1966 | Giordano | 83/157 X |
| 3,861,258 | 1/1975 | Irvine | 83/157 X |

*Primary Examiner*—Willie G. Abercrombie
*Attorney, Agent, or Firm*—Eugene V. Mandel

[57] ABSTRACT

A knife ram operated sliding work support attachment for a metal cutting shears.

6 Claims, 2 Drawing Figures

WORK SUPPORT FOR SHEAR

BACKGROUND OF THE INVENTION

This invention relates to work supports and, in particular, to work supports for metal cutting shears and the like. More particularly, it relates to adjustable work supports. More particularly, it concerns disappearing work supports.

Some disappearing work supports have been known in the prior art. Most such supports have been exceedingly complex and expensive, requiring sizable investment which consequently appreciably restricted their employment.

The object of this invention is the provision of an easy to use, simple to install, adjustable, disappearing work support for use with such machines as metal cutting shears. A further object is to provide adjustability to the particular piece of equipment. Another object is to permit adjustability to the size of the work. The prime purpose is to reduce the number of laborers required. Another purpose is to increase safety by reducing manual handling of sheets and cut pieces.

The essence of this invention is a simple disappearing work support and safety attachment for such machinery as metal cutting shears. The work support is withdrawn by the cutting ram return and advanced by an adjustable spring bias. The work support mechanism can be disconnected when not desired for very short runs and setups. The work support can be adjusted for position and stroke to suit the work.

DESCRIPTION OF DRAWINGS

Further objects and advantages of this invention will appear more clearly from the following description of a non-limiting illustrative embodiment and the accompanying drawings in which like numerals designate like parts thruout the several views.

DESCRIPTION OF TYPICAL EMBODIMENT

Figure 1:
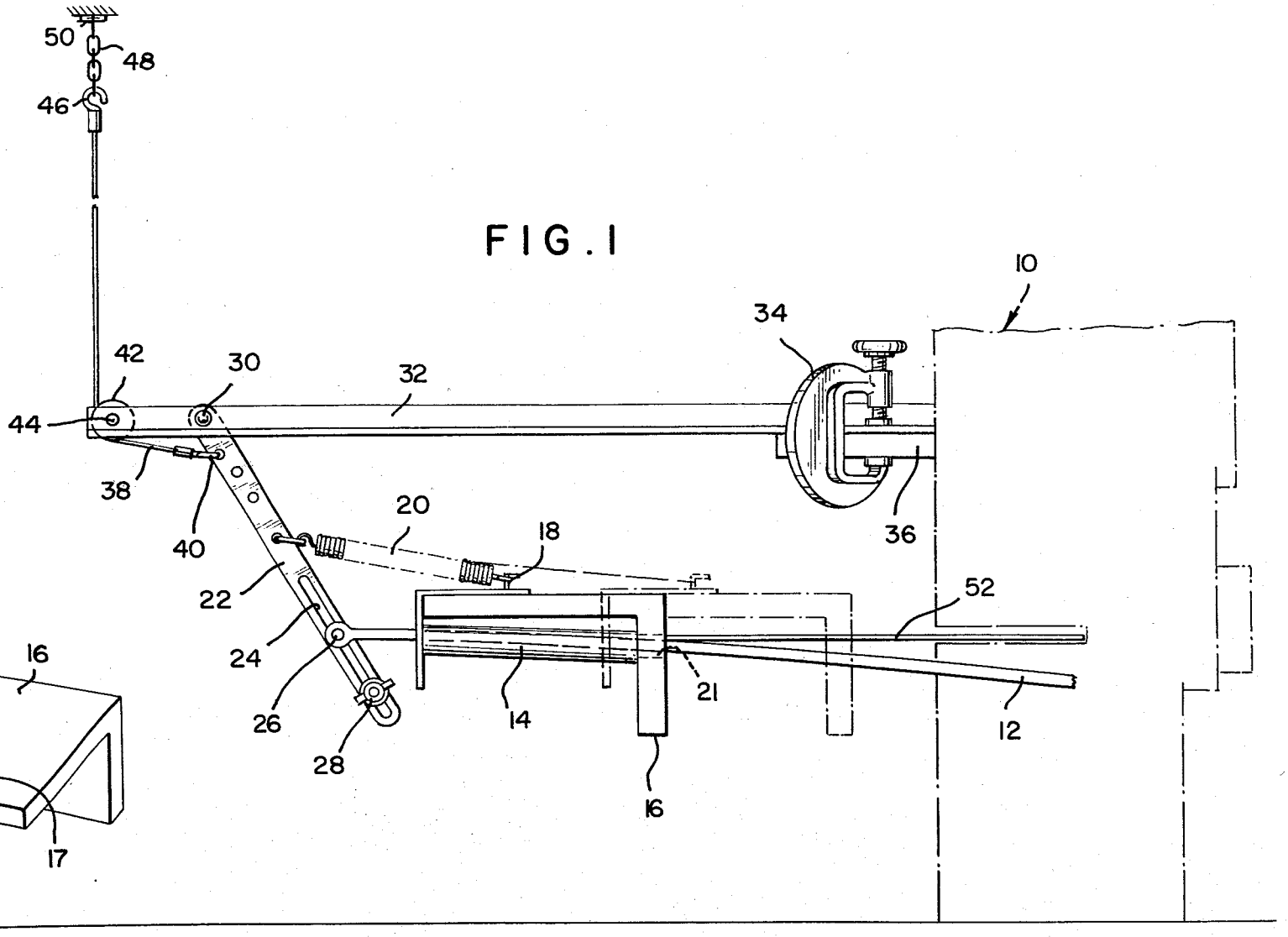
FIG. 1 is an elevation view of the device installed on a shears.
Figure 2:
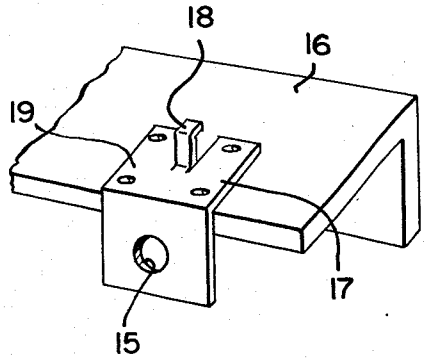
FIG. 2 is a pictorial view of the attachment of the movable table.

In the drawings a cutting support rod 12 embodying features of the invention is illustrated.

On a mechanical metal cutting shears 10 having a reciprocating ram on which part 36 is any convenient extension to which is attached by a heavy duty clamp 34 as a quick expedient or other known fasteners a long extension 32 which may be an angle beam on which is mounted a free running grooved wheel or pulley 42 and a pivot 30 for slotted bar 22 in the slot 24 of which is engaged fastener 26 for rod 12. Pivot 30 and stub axle 44 for pulley 42 and fastener 26 may be made as a shoulder screw or pin or other known method. To bar link 22 is attached spring 20 anchored at 18 by fasteners 19 to the moveable back gauge 16 or other shearing machine part. Spring 20 pulls sliding rod 12 into the work 52 space where it supports the edge of the work. An adjustable relatively inextensible flexible linkage comprised of hook 46, chain 48, anchor 50, cable 38 and hook 40 passing around pulley 42 is attached to slotted link 22 and pulls the link 22 back pulling rod 12 out of the work space when cutting ram 36 descends. Bracket 17 with hole 15 has tubing 14 welded to it and supports guides and contains sliding rod 12 which passes thru hole 21.

Adjustable stop 28 comprised of such fasteners as a bolt and nut is slidable in slot 24 to limit the position of sliding rod 12.

When the cutting ram 36 descends to the bottom of its stroke, sliding rod 12 is withdrawn permitting cut work 52 to fall down and out of the machine. When the cutting ram 36 ascends to admit the next piece of work 52 and to prepare for the next cutting stroke, spring 20 force pulls sliding rod 12 back into work 52 support position.

Several such devices may be used depending upon the width of sheet being cut. Part 36 may have holes drilled in at suitable locations to permit brackets 17 with holes 15 and tubes 14 to be mounted and corresponding holes 21 drilled.

The components and materials used may be any of those known and readily available.

By reducing the requirement for a laborer to reach into the machine, safety is increased.

The invention includes all novelty residing in the description and drawings. It is obvious to those skilled in the art that various minor changes can be made without departing from the concept of this invention and all such as fall within the reasonable scope of the appended claims are claimed.

What is claimed is:

1. In a metal cutting shears having a movable ram to carry the moving knife blade, a work supporting attachment comprising a sliding member which supports the edge of the work, said sliding member being reciprocated by the motion of the ram, the descent of the ram removing the support from the work area, a slotted link pivotably mounted to the ram, the sliding member engaging the slotted link in the slot, an adjustable tension member to pull the link in one direction and a spring to pull the link in the other direction.

2. In an attachment as in claim 1, the attachment is at least partially removeable from the machine.

3. In an attachment as in claim 1, the spring returns the sliding member to the work area.

4. In an attachment as in claim 1, further comprising a tube for guiding the sliding member.

5. An attachment as in claim 1 being adjustable to different positions.

6. An attachment as in claim 1 further comprising an adjustable stop on the slotted link and slideable in the slot.

* * * * *